United States Patent [19]

Tesch

[11] Patent Number: 4,962,554

[45] Date of Patent: Oct. 16, 1990

[54] QUILTED BED COVER

[76] Inventor: Günter Tesch, Avenue Jean-Marie-Musy 15, Fribourg, Switzerland, CH-1700

[21] Appl. No.: 322,995

[22] Filed: Mar. 14, 1989

[30] Foreign Application Priority Data

Mar. 28, 1988 [CH] Switzerland ..... 01129/88

[51] Int. Cl.[5] ..... A47G 9/00

[52] U.S. Cl. ..... 5/502; 5/500; 2/97; 2/272; 112/420; 428/102

[58] Field of Search ..... 5/502, 500, 482, 471, 5/483, 459; 2/97 X, 164, 272 X, 69.5; 112/420, 439; 428/102

[56] References Cited

U.S. PATENT DOCUMENTS

| | | | |
|---|---|---|---|
| 1,963,177 | 6/1934 | Smallish | 5/502 |
| 2,087,505 | 7/1937 | Davis . | |
| 2,094,334 | 9/1937 | Weaver | 428/102 |
| 2,544,797 | 3/1951 | Lippmann | 5/502 |
| 3,242,508 | 3/1966 | Smithson | 5/502 |
| 3,278,954 | 10/1966 | Barhite . | |
| 3,563,837 | 2/1971 | Smith | 5/502 |
| 4,413,030 | 11/1983 | Tesch et al. . | |
| 4,533,580 | 8/1985 | Otty | 428/102 |

FOREIGN PATENT DOCUMENTS

| | | | |
|---|---|---|---|
| 0013427 | 8/1980 | European Pat. Off. . | |
| 2438454 | 8/1980 | France . | |
| 66687 | 8/1943 | Norway | 428/102 |
| 192315 | 8/1937 | Switzerland | 428/102 |
| 2139492 | 11/1984 | United Kingdom | 5/502 |

*Primary Examiner*—Gary L. Smith
*Assistant Examiner*—Flemming Saether
*Attorney, Agent, or Firm*—Bacon & Thomas

[57] ABSTRACT

A quilted cover, in particular a bed cover, with two outer sheets between which a filling is placed, is described. It is characterized in that, in the area quilting, a plurality of fiber aggregates of spherically tangled fibers are located, through which the two outer sheets of the cover are joined together. Conveniently, the two outer sheets are joined together in the area of the quilting with threads penetrating through the fiber aggregates, with the threads being sewn through the two outer sheets and the fiber aggregates. A cover, in particular a bed cover, is created in this manner, which may be produced more simply and more flexibly and thus less expensively than known covers, while containing no cold bridges in the quilting areas.

10 Claims, 1 Drawing Sheet

QUILTED BED COVER

The invention concerns a quilted covers, in particular bed covers, with two outer sheets containing a filling therebetween, are well known. Covers of this type are usually prepared by sewing together the outer sheets on three sides, turning the case formed in this manner inside out, and filling it with down, feathers, or the like.

The down or feathers are usually blown into the case. Longitudinal quilting, whereby a so-called "tubular" cover is obtained, may be effected prior to the insertion of the filling by means known in the art. Following the completion of the filling process, additional cross-quilting may be effected so that a so-called "panel" cover is obtained.

There are numerous types of quilting, with a fundamental distinction being made between "normal" quilting and "web" quilting. In normal quilting, the two outer sheets rest directly against each other in the quilted areas (i.e., the two outer sheets are connected to each other merely by sewing thread). In web quilting, the two outer sheets are connected by webs which are sewn to each of the outer sheets.

In normal quilting, there is no filler material present between the two outer sheets in the quilted area. Accordingly, a "cold bridge" (a zone through which heat passes very easily) is present. However, covers prepared by the normal quilting process have an advantage compared to web-quilts, because they can be produced much more easily and inexpensively.

When filler material is inserted, particularly by blowing, into a cover prepared by normal quilting, the filler material does not reach the immediate vicinity of the quilting stitches, because the outer sheets do not separate from each other sufficiently in these areas to allow penetration of a thickness of filling material into these areas. Thus, the so-called "cold bridge" occurs not only in the quilted areas themselves, but also in their immediate vicinities. This is particularly true if the particles of filler material are large. The larger the filler particles, the larger will be the vicinity around the quilting which contains no filling.

An example of normal quilting is the so-called "point-point" quilting, in which spaced apart, individual points are stitched. In a cover with dimensions of 1.35 m $\times$2 m, 40 to 60 such quilted points may be provided. Any distention of a cover of this type is thereby prevented. Such quilting may be effected prior to the filling of the case, as the case may be filled readily between the quilted points by blowing and tapping which are means known in the art.

Web quilts are produced by web quilting means in order to reduce the occurrence of cold bridges, or to eliminate them entirely. Each web as a rule comprises a strip of material, which, at both ends, is sewn to one of the two outer sheets. However, the sewing of webs to the two outer sheets is substantially more complex and expensive than normal quilting, as the webs are usually attached after the peripheral joining of the two outer sheets to each other. Thus, the seam which joins a web to an outer sheet is partially effected at a distance from the only open side of the case remaining after the peripheral joining of the two outer sheets. Furthermore, numerous individual webs must be applied to prevent the sliding of the filler material.

The object of the present invention is to provide a cover, in particular a bed cover, of the aforedescribed generic type, which may be produced in a simpler and more flexible manner, and therefore at a lower cost, while still avoiding the presence of cold bridges in the quilted zones.

This object is attained by the cover of the present invention. In the cover of the present invention, which is, in particular, a bed cover, two outer sheets contain a filler between them. A plurality of fiber aggregates of spherically tangled fibers is located in the immediate areas through which the two outer sheets are joined together.

The invention incorporates a novel type of quilting, wherein the two outer sheets are maintained spaced apart. Furthermore, a web is used which may correspond to the material of the filling, rather than a web of material which is similar to the material of the outer sheets. In this manner, formation of "thin spots" and cold bridges is prevented.

The two outer sheets may be connected to each other by quilting with threads which penetrate the fiber aggregates. Thus, the threads are sewn through the two outer sheets and through the fiber aggregates.

The stitches of the quilting are distributed over the entire surface of the cover and may be spaced apart from 100 mm to 400 mm. The distance employed depends on the type of material of the outer sheets, the nature of the fiber aggregates used in the quilting, the length and height of the quilting, the filler materials employed, etc.

The quilting seams may be 6 to 20 mm long. Advantageously, the fiber aggregates penetrated by the quilting threads may have diameters from 5 mm to 20 mm, preferably about 15 mm.

If the quilting threads are sewn loosely, i.e., if the threads are under a slight tension or none at all, the cover may have a thickness in the quilting zone essentially corresponding to the thickness of the cover over its entire area. In particular, in the area of the quilting seams, the two cover sheets may be spaced apart 2 mm to 30 mm, preferably 2 to 10 mm.

According to a particular form of embodiment, the fiber aggregates penetrated by the quilting threads have fiber ends projecting in the form of spikes or thorns from said aggregates. If identical or similar fiber aggregates are used as the filler material, they may be releasably held to the body of fiber aggregates fixedly attached to the quilt as webs. Slipping of the fiber aggregates which are not quilted is thereby prevented or at least reduced.

Further details and advantages of the invention will become apparent from the examples of embodiment described with reference to the drawing.

DETAILED DESCRIPTION

Figure 1:
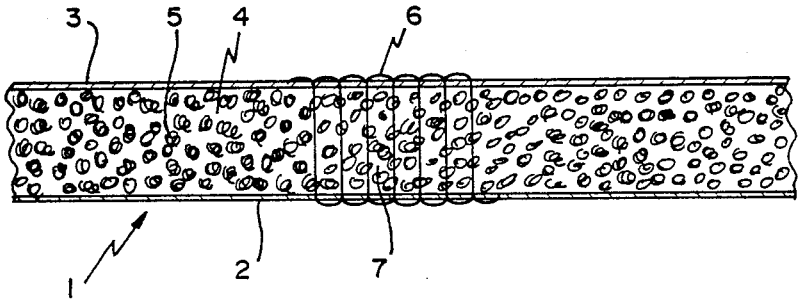
FIG. 1 is a sectional view of a cover showing the web which is formed by the fiber aggregates, quilting threads, and other filler, materials, with the quilting being loosely applied.

The figures show a segment of a longitudinal section through a quilted cover 1 in a quilted area. The cover 1 comprises two outer sheets 2 and 3, between which a filler 4 is placed. This filler 4 may comprise spherical fiber aggregates 5 comprising spherically tangled fibers; however, the filler 4 may also comprise conventional filler materials, such as down, feathers, or the like. The two outer sheets 2 and 3 are connected with each other, i.e., quilted together, in certain locations by threads 6.

Fiber aggregates 7 of spherically tangled fibers through which the quilting threads 6 penetrate are located in quilting areas through which the quilting threads 6 penetrate. The quilting threads 6 fixedly hold the fiber aggregates 7. The two outer sheets 2 and 3 are spaced apart by means of said fiber aggregates 7 held by the quilting threads 6, in the area of quilting. In particular, the outer sheets 2 and 3 do not rest upon each other, as in conventional quilts. The cold bridges heretofore present at the quilting seams are thereby avoided.

In the form of embodiment according to FIG. 1 the quilting threads are sewn loosely through the fiber aggregates 7, so that the cover 1 has the same thickness in the quilted area as adjacent to it. The sewn fiber aggregates 7 have an approximately spherical shape, similar to that of the fiber aggregates 5 which may be used for the rest of the filling.

Figure 2:
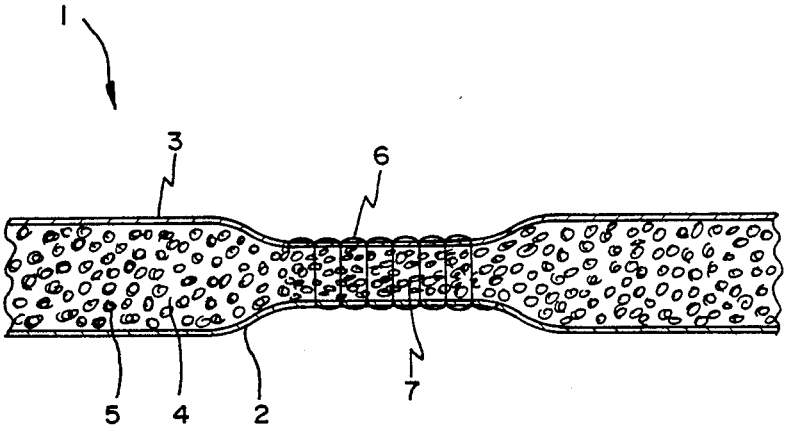
FIG. 2 shows a sectional view of a cover with the quilting being tightly applied.

In the form of embodiment according to FIG. 2 the quilting threads 6 are sewn more tightly through the fiber aggregates 7, so that the cover 1 has a smaller thickness in the quilted area than adjacent to it. Here, the sewn fiber aggregates 7 are more flattened than in the embodiment shown in FIG. 1, as they are compressed during the sewing process. The other fiber aggregates 5 of the filling 4 remain of an approximately spherical shape. However, due to the tighter packing of the sewn fiber aggregates 7, the cover 1 is as permeable/impermeable relative to heat and humidity in the quilting areas as in the nonquilted zones.

The fiber aggregates 7 used in the quilts may be preworked prior to their insertion into the case of the cover 1. In particular, the aggregates 7 intended for each individual quilting area may be joined together prior to insertion into the cover.

The joining of the fiber aggregates 7 prior to insertion into the cover may be achieved by virtue of the fact that the fiber aggregates 7 may be provided with fiber ends which project from the aggregate in spikes or thorns. The projecting fiber ends may thus hook into the fibers of adjacent fiber aggregates 7. Alternatively, the fiber aggregates 7 may be provided with binder fibers, which can be melted to create a joint between adjacent fiber aggregates.

A cover of this type may be prepared by inserting a plurality of optionally prestrengthened and/or connected fiber aggregates 7 between the two outer sheets 2 and 3 which form the case of the cover 1 at locations where the novel quilting is to be carried out. The cover 1 is then sewn, i.e., quilted, through the fiber aggregates 7, for example linearly, with a seam length preferably between 6 to 20 mm.

It is also possible to fill the entire case with fiber aggregates 5 and 7 and then quilt the cover in the locations desired (i.e., where fiber aggregates 7 are located). It is advisable to use fiber aggregates 7 which at least lightly adhere to each other, in order to prevent the displacement of the fiber aggregates 7 from the area of the quilting during sewing, at which time a perpendicular pressure is applied to the two outer sheets 2 and 3.

Conventional quilting/sewing machines may be used for the quilting, such as those also employed for the aforedescribed normal quilts. No expensive web quilting machines are necessary. Double seams, broad stitches, decorative stitches, or the like, may be applied.

The fiber aggregates used in the invention may preferably be spherical fiber aggregates as disclosed and claimed in copending U.S. patent application Ser. No. 089,403, filed Aug. 26, 1987, now U.S. Pat. No. 4,820,574, and U.S. patent application Ser. No. 089,404, filed Aug. 26, 1987, now U.S. Pat. No. 4,814,229.

What is claimed is:

1. A quilted cover comprising two outer sheets and a filling between the two sheets, wherein a plurality of fiber aggregates of spherically tangled fibers is located at quilting areas, and wherein the two outer sheets of the cover are connected by quilting through the fiber aggregates wherein quilting threads are sewn loosely under a slight tension and penetrate the two outer sheets and the fiber aggregates in the quilting areas, such that the two outer sheets are spaced apart from one another in the quilting areas.

2. A cover according to claim 1 wherein the quilting areas comprise quilt seams.

3. A cover according to claim 2, wherein the quilt seams are 6 to 20 mm long.

4. A cover according to claim 1, wherein the fiber aggregates have diameters of 5 to 20 mm.

5. A cover according to claim 4, wherein the fiber aggregates have diameters of about 15 mm.

6. A cover according to claim 1, wherein the outer sheets are spaced apart 2 to 30 mm at the quilting areas.

7. A cover according to claim 6, wherein the outer sheets are spaced apart 2 to 10 mm at the quilting areas.

8. A cover according to claim 1, wherein the fiber aggregates are provided with fiber ends which project from them.

9. A cover according to claim 1, wherein the filler is comprised of the same fiber aggregates as are used in the quilting areas of the cover.

10. A cover according to claim 1, wherein the filler is down or feathers.

* * * * *